United States Patent [19]

Hattori et al.

[11] Patent Number: 4,575,590

[45] Date of Patent: Mar. 11, 1986

[54] THRUST-IN OPERATION TYPE SWITCHING DEVICE

[75] Inventors: Masaichi Hattori; Kaneyasu Arakawa; Akira Hanaki, all of Aichi, Japan

[73] Assignee: Kabushikikaisha Tokairikadenkiseisakusho, Aichi, Japan

[21] Appl. No.: 635,299

[22] Filed: Jul. 27, 1984

[30] Foreign Application Priority Data

Jul. 29, 1983 [JP] Japan ..... 58-119268

[51] Int. Cl.[4] ..... H01H 9/26

[52] U.S. Cl. ..... 200/5 B; 200/5 E; 200/153 J

[58] Field of Search ..... 200/5 A, 5 B, 5 C, 5 E, 200/153 J

[56] References Cited

U.S. PATENT DOCUMENTS 4,447,686 5/1984 Fieber et al. ..... 200/153 J

*Primary Examiner*—Harry E. Moose, Jr.
*Assistant Examiner*—Morris Ginsburg
*Attorney, Agent, or Firm*—Steele, Gould & Fried

[57] ABSTRACT

A switching device comprises a movable member which makes the first switch turn to an opposite phase at the first thrust-in position and makes the second switch turn to an opposite phase at the second thrust-in position, a first locking means which locks the movable member at the first thrust-in position, a second locking means comprising a torsion coil spring engaging member and a heart type cam recess on which the engaging member slides, which locks the movable member at the second thrust-in position, and a reset member which releases the movable member from the locking state. The first and second switches are selectable to set and can be alternatively operated only by repeated thrust-operation.

4 Claims, 9 Drawing Figures

THRUST-IN OPERATION TYPE SWITCHING DEVICE

FIELD OF THE INVENTION

This invention relates to a switching device in which a manual thrust-in operation of a single movable member actuates at least two different switches, and more particularly to a thrust-in operation type switching device in which a movable member can be moved to either a first or second thrust-in position by an external thrust-in operation to operate an individual switch at each position.

DESCRIPTION OF THE PRIOR ART

The conventional thrust-in operation type switching device in which a plurality of switches are selectively operated comprises a movable member thrusted by the push-button provided in correspondence to each switch, a lock plate locking a movable member at a thrust-in position, and a reset member forcing the lock plate in the direction of resetting the switches to release the movable member from a lock.

On the above conventional type switching device, since an individual movable member must be set at each switch, the switching device entirely becomes large.

OBJECT OF THE INVENTION

It is an object of the present invention to provide an improved thrust-in operation type switching device which is small in size and which is provided with a plurality of switches.

It is another object of the present invention to provide an improved thrust-in operation switching device in which a single movable member thrustly operated can selectively actuate a plurality of switches and lock them in the selected state.

It is further object of the present invention to provide an improved thrust-in operation type switching device in which only alternative thrust-in operation of the movable member can repeatedly turn two switches open and closed oppositely from each other.

SUMMARY OF THE INVENTION

The switching device of the invention comprises the structure of which the movable member, moved straightly by the thrust-in operation, is incorporated in the switch frame. When the movable member is thrusted into the first thrust-in position from the original position, the movable member is kept at the first thrust-in position by the first locking means and subsequently when the movable number is further thrusted into the second thrust-in position, the movable member is also kept there by the second locking means.

In addition the switching device comprises the first and second switches: the first switch is turned to the opposite phase at the first thrust-in position; and while the second switch is also turned to the opposite phase at the second thrust-in position. A single reset member built in the switch frame is provided for releasing the movable member either at the first or second locking means and returning the member to the original position. Thus the first and second switches have been reset.

When the movable member is further thrusted from the second thrust-in position to make the second locking means release the lock, the movable member will return to the first thrust-in position. In such a manner the movable member can be moved back and forth. Therefore, only the operation of the movable member operates the first and second switches to turn the opposite phase each other alternatively.

Other and further objects of this invention will become obvious upon an understanding of the illustrative embodiments about to be described or will be indicated in the appended claims, and various advantages not referred to herein will occur to one skilled in the art upon employment of the invention in practice.

DETAILED DESCRIPTION

Figure 1:
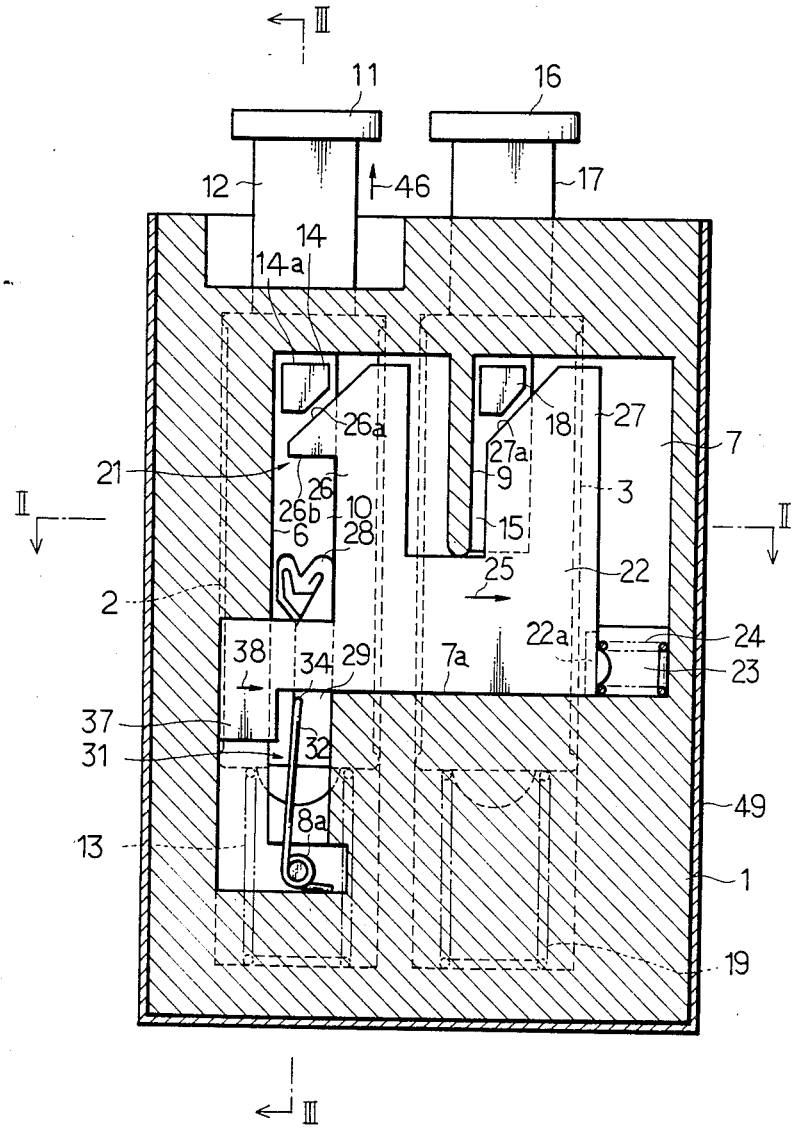
FIG. 1 is a plan view, partly in section, of the switching device of the first embodiment according to the invention.
Figure 2:
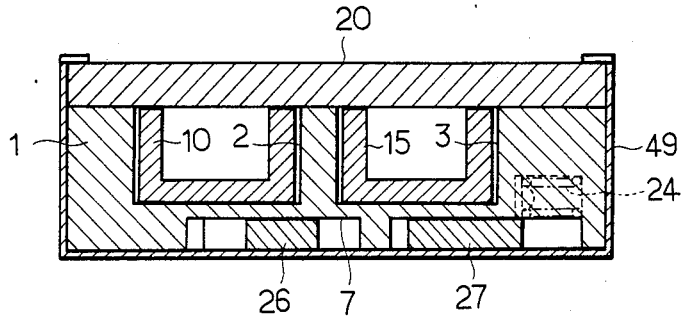
FIG. 2 is a traverse sectional view along the line II—II of FIG. 1.
Figure 4:
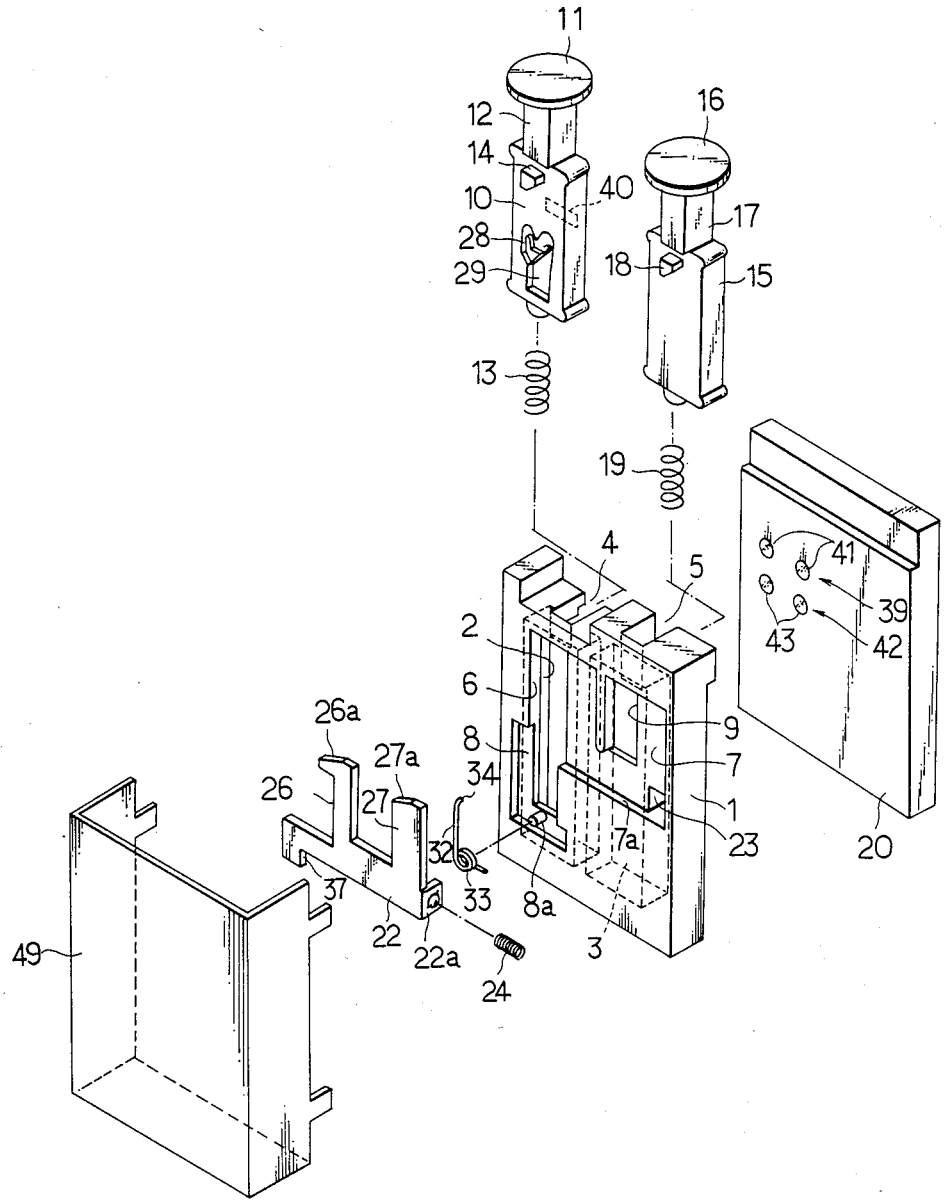
FIG. 4 is a perspective exploded illustration.

Referring first to the embodiment of the invention shown in FIG. 1 and FIG. 4, a plastic switch frame 1 has sliding recesses 2 and 3 formed at the bottom with apertures 4 and 5 respectively in the same side, which extend to the longitudinal direction in parallel. The two recess areas 7 and 8 are slightly recessed from the top surface of the switch frame. In the recess 7 a slot 9 communicating with the sliding recess 3 is formed, and the other recess 8 is formed along the aperture in the left end of the slot 6, narrower and shorter than the sliding slot 2. A square movable member 10 is straight slidably inserted in the sliding slot 2 of the switch frame 1. A stem 12, which is formed with a push-button 11 at an end of it and inserts held together as a unit of the movable member 10, is through the aperture 4 of the sliding slot 2. A reset spring 13 is interposed between the opposite end of the movable member and the closed end of the aperture 4 and continuously forces the movable member 10 to the most upward reset position. Near the front of the movable member 10, an engaging hook 14 projects through the slot 6 in the switch frame 1. The reset member 15, angularly shaped similar to the member 10, having a push-button 16, stem 17 and projection 18, is slidably inserted into the sliding recess 3 in the switch frame 1. In this state, the projection 18 extends through the slot 9 in the sliding recess 3 and the reset member 15 is always exerted toward the reset position by another reset spring 19 arranged in like the reset spring of the movable member 10.

Figure 5:
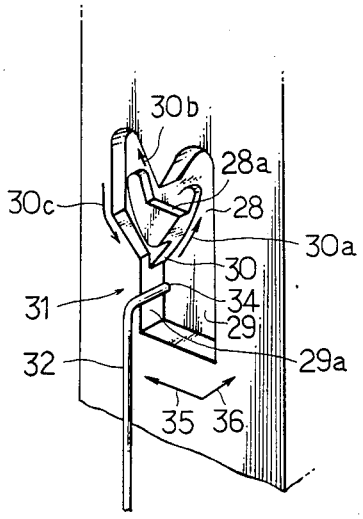
FIG. 5 is an enlarged detail of the second locking means in the switching device.

The switch frame 1 includes a plastic lid plate 20 accommodated to cover the bottom of the switch frame 1 after the movable member 10 and reset member 15 have been built in the sliding recesses 2 and 3 respectively. The first locking means 21 comprises the engaging hook 14 of said movable member 10 and the first locking member 22. The first locking member 22, substantially shaped as a plate and laid in the recess 7, is movable along a wall 7*a* of the recess 7 in the direction of the perpendicular to the sliding direction of the movable member 10, and is forced toward the opposite direction of the lock releasing direction, shown by the arrow 25, by the reset spring 24 which is disposed between a projection 22*a* integrally formed with locking member 22 and the inner side of the recess 23 which is formed as a depression from the top of the frame. The locking member 22 has two legs 26 and 27 with inclined surfaces 26*a* and 27*a* at their ends respectively. Thrusting the movable member 10 and reset member 15 inwardly makes the engaging hook 14 and projection 18, respectively depressed the inclined surface 26*a* and 27*a*, to shift the locking member 22 to the releasing direction indicated by the arrow 25. The edge 26*b* which is engageable with a side wall 14*a* of the engaging hook 14 is formed at the opposite side of the inclined surface 26*a* of the leg 26. A cam recess 28 and side recess 29 are formed in the opposite half area of the engaging hook 14 on the movable member 10 as shown in detail in FIG. 5. The cam recess 28, being essentially a closed heart configuration, gradually shallows with advance toward the arrow 30*a* from the side recess 29, and at the end an erecting wall surface 30 is formed as the boundary against the side recess 29.

A second locking member 32 comprises, for instance, an engaging element of a torsion coil spring 33 engaging with the projection 8*a*, which transmits a force in the direction of the arrow 35 and 36 so as sliding head 34 may securely slide on the wall 29 and the bottom surface of said side recess 29*a* with a proper pressure.

An auxiliary reset portion 37 for releasing the locking means 31, which extends from the first locking member 22 which is laid in the recess 8, shifts across the location of the sliding head 34 of the second locking means 32 when the first locking means 22 shifts toward the releasing direction. In the sliding head 34 engaging with a wall 28*a*, the sliding head 34 largely projecting in the shallowed cam recess 28 is driven toward the direction indicated by the arrow 25 by the auxiliary reset portion 37 to release such engagement of the head 34 and wall 28*a*, and is forced into the side recess 29. When the sliding head 34 is in the side recess 29, it is impossible to contact with the auxiliary reset portion 37 since the depth of the side recess 29 is sufficiently large.

Figure 3:
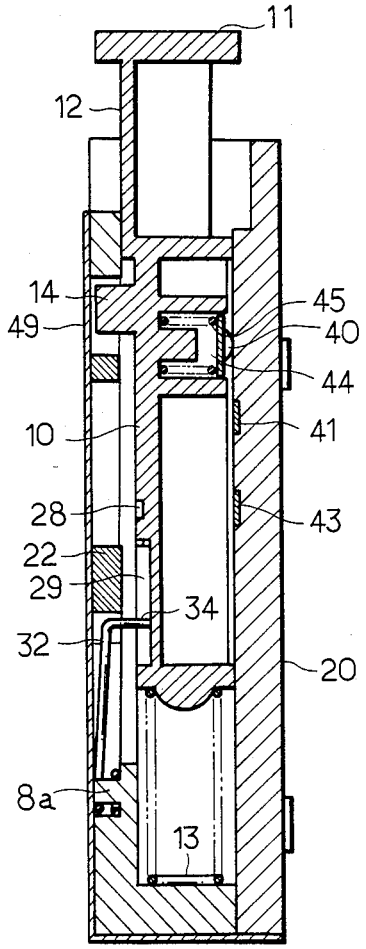
FIG. 3 is a vertically sectional view along the line III—III of FIG. 1.

Referring to FIG. 3, a first switch 39 comprises a movable contact 40 built in the recess 44 formed in the rear portion of the movable member 10 together with the spring 45 so that the movable contact 40 may slide on the lid surface 20 with a spring pressure applied from the spring 45, and a pair of first fixed contacts 41 secured on the lid 20. A second switch 42 comprises the movable contact 40 and a pair of second fixed contacts 43 secured on the lid 20. The first contacts 41 are so arranged as to contact with the movable contact 40 when the movable member 10 is in the first thrust-in position wherein the engaging hook 14 engages with the edge 26*b*. While the second fixed contact 43 is so arranged as to contact with the movable contact 40 when the movable member 10 is in the second thrust-in position of which the sliding head 34 of the locking member 32 engages with the wall 28*a* of the cam recess 28. The plastic switch frame 1 is finally covered by a cover 49.

Figure 6:
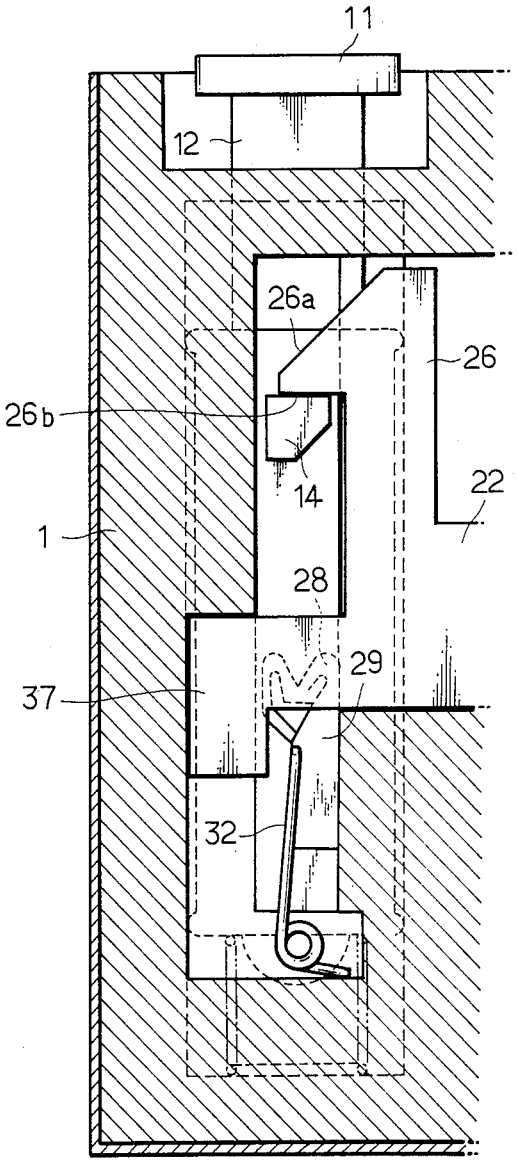
FIG. 6 and FIG. 7 are fragmentary views of FIG. 1 for explaining individual functions respectively.

For the operation of the switch, when the movable member 10 is thrusted from the push-button 11, the engaging hook 14 slides and passes on the inclined surface 26*a* of the first locking member 22. During the passing process on the inclined surface 26*a*, the first locking member 22 moves back and forth in the direction of the arrow-marking 25, and finally, the engaging hook 14 engages with the edge 26*b* of the locking member 22 so that the movable member 10 is locked at the first thrust-in position (Refer to FIG. 6). At this stage the first switch 39 has been turned to the closed state from the open. In the state of FIG. 6, when the movable member 10 is further thrusted from the push-button 11, the sliding head 34 of the second locking means 32 comes into the cam recess 28 along the erected wall surface 30 from the side recess 29 to engage with the wall 28*a* (Refer to FIG. 7), which locks the movable member 10 to the second thrust-in position against the force of the reset spring 13 toward reseting of the switch, that is, the moving force for projecting from the switch frame 1. At this stage the second switch 42 has been turned to the closed phase from the open.

Figure 7:
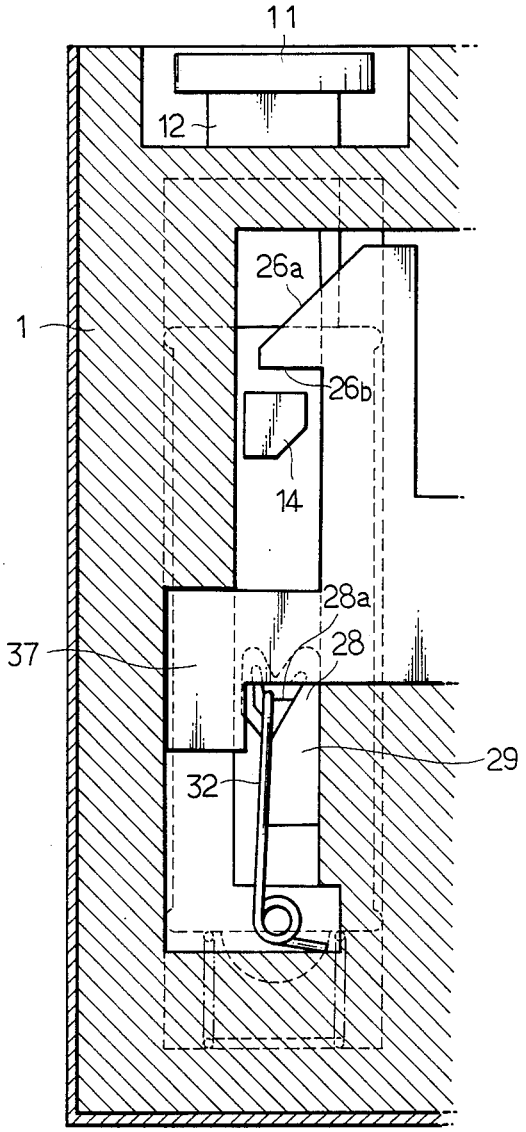

In the state shown in FIG. 7, when the movable member 10 is further thrusted by the push-button 11, the sliding head 34 of the second locking member 32 moves in the direction of the arrow 30*b* away from the wall 28*a*. Subsequently when the thrust against the push-button 11 is released, the movable member 10 is moved to the resetting direction indicated by the arrow 46, and the head 34 is advanced along the arrow 30*c*, and then finally enters into the side recess 29. Thus the movable member 10 is released from the second locking means 31 to return to the first thrust-in position shown in FIG. 6 wherein the engaging hook 14 engages with the edge 26*b* of the first locking member 22.

As shown in FIG. 6, in the state of the movable member 10 locked at the first thrust-in position, when the reset member 15 is thrusted by pressure on the push-button 16, the projection 18 thrusts on the inclined surface 27*a* of the first locking member 22 to shift the locking member 22 toward the releasing direction indicated by the arrow 25, which releases the movable member 10 from the locking state built up by the engagement of the engaging hook 14 and the edge 26*b*. Then the movable member 10 is moved, in the direction of the resetting point indicated by the arrow 46, by the elastic force of the reset spring 13. As shown in FIG. 7, in the state of the movable member 10 locked at the second thrust-in position when the reset member 15 is thrusted by pressing the push-button 16, in similar manner as above described, the first locking member 22 shifts in the direction indicated by the arrow 25 together with the auxiliary reset member 37, which drives the sliding head 34 away from the wall 28*a* in the direction indicated by arrow 38. In this stage because the edge 26*a* is clear from the travelling path of the engaging hook 14, the movable member 10 directly shifts to the reset position shown in FIG. 1.

As described in the above, the switching device has the following mode: The first, when the movable member 10 is thruted to the first thrust-in position, the member 10 is locked at this position to keep the first switch 39 closed. Subsequently when the member 10 is thrusted to the second thrust-in position, the second switch 42 is turned to the closed position with simultaneous opening of the first switch. The second, when the movable member 10 is locked at either the first or the second thrust-in position, the member 10 can be returned to the reset position by the operaton of a unit of the reset member 15. The third, the repeatedly thrusting operation on the movable member 10 is to make the movable member 10 shift back and forth between the first thrust-in position and the second thrust-in position, that is, the first and second switches 39 and 42 can easily be switched alternatively without the operation of the reset member 15.

The switch of the present invention having such function is useful, for instance, for a light switch of a motorcar to be turn from "OFF" to "SMALL LAMP ON" and "HEAD LIGHT ON", or for an air conditioning switch to be turned from "OFF" to "BREEZE" and "STRONG".

Since a single unit of the movable member 10 can separately operate a plurality of individual switches, that is, the first and second switches 39 and 42, a small number of the movable members are required and the switching device entirely becomes small. In addition, there is ease and simplicity of the operation such that alternative switching of the two switches 39 and 42 requires only repeated thrust-operation of the movable member 10 without the operation of the reset member 15. Furthermore, to entirely retrieve the movable member 10 from the second thrust-in position, the reset member 15 is thrusted once without the same times of thrust-operation as that of the switch stage.

Figure 8:
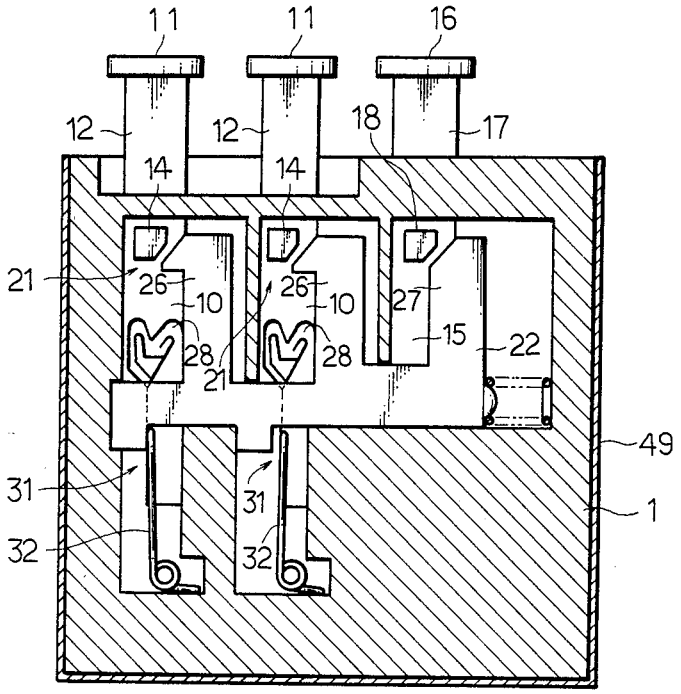
FIG. 8 is a plan view, partly in section, of the switching device of the second embodiment according to the invention equivalent to FIG. 1.

The second embodiment of this invention is shown in FIG. 8, which comprises two pairs of the switch unit described in the above, shown in FIG. 1 to 7.

Figure 9:
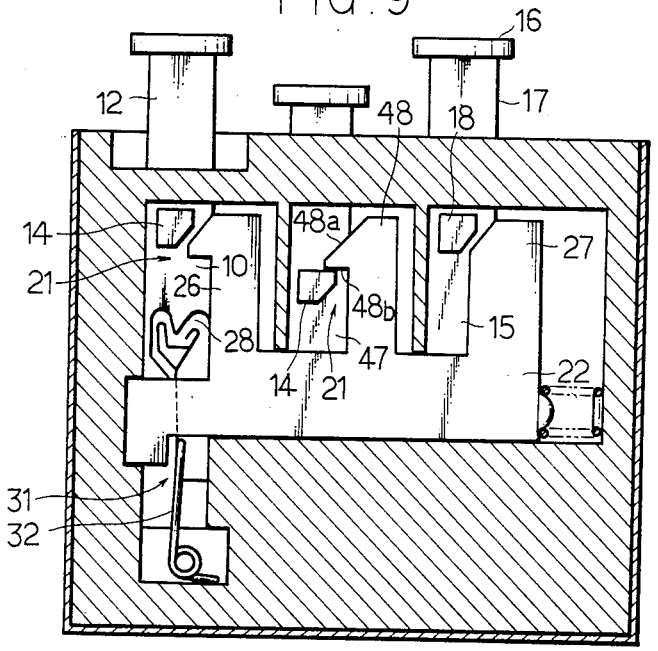
FIG. 9 is a plan view, partly in section of the switching device of a third embodiment according to the invention equivalent to FIG. 1.

The third embodiment of this invention shown in FIG. 9 comprises a thrust-in movable member 47 which is built with a movable member 10 in which the cam recess 28 is eliminated, and the locking means 22 comprises leg 48, inclined surface 48*a* and edge 48*b*.

The foregoing disclosure and drawings are merely illustrative of the principles of this invention and not to be interpreted in a limited sense.

What is claimed is:

1. A thrust-in operation type switching device comprising, in combination:

a switch frame 1;

a movable member 10 provided in said switch frame 1 for straight motion by thrust-in operation from an initial position to a first thrust-in position and further from the first thrust-in position to a second thrust-in position;

a first reset spring 13 provided in said switch frame 1, the first reset spring biasing between the switch frame and the movable member to always urge said movable member 10 in the direction of the initial position thereof;

first and second switches 39 and 42 positioned adjacent to the switch frame, the first and second switches being adapted to be operated by shifting the movable member 10 to the first and second thrust-in positions respectively;

a first locking means 21 for locking the movable member 10 at the first thrust-in position without interrupting further motion thereof in the direction of the second thrust-in position, said locking means 21 comprising an engaging hook 14 secured on the movable member 10, a first locking member 22 reciprocally associated in the switch frame 1 for motion between a first position for engaging with said hook 14 and a second position for disengaging therefrom, and a second reset spring 24 biasing between the first locking member and a portion of the switch frame 1 for always urging said first locking member 22 in the direction of said second, disengaging position, whereby said hook 14 engages with said locking member 22 when the movable member 10 is thrust from the initial position to the first thrust-in position;

a reset member 15 provided in the switch frame 1 for motion by thrust-in operation from an initial position to a thrust-in position, the reset member being contacted by a reset spring 19, the reset spring being positioned to bias between the switch frame 1 and the reset member to continuously urge the reset member towards said initial position, said reset member 15 being adapted to move the first locking member 22 in the direction of the second disengaging position and disengaging it from the hook 14 when the reset member 15 is moved to the thrust-in position;

a second locking means 31 for locking the movable member 10 at the second thrust-in position when it is shifted via the first thrust-in position to the second thrust-in position, said second locking means 31 comprising a grooved cam provided on one surface of the movable member 10 in a substantial closed loop configuration and having a wall 28*a* and an elastic locking member 32 one end of which is supported in the switch frame 1 and the other end of which serves as a sliding head 34 for moving via said wall 28*a*along the groove every time the movable member 10 reciprocally moves, whereby said sliding head 34 engages with said wall 28*a* and locks the movable member 10 when it is thrust to the second position, said sliding head 34 being adapted to disengage from the wall 28*a* and to move the movable member 10 back to the first thrust-in position when it is further thrust slightly inwardly from the second thrust-in position; and an auxiliary reset member 37 connected to and adapted to move with the first locking member 22 and which is adaptable to be engageable with part of the second locking member 32 only when the sliding head 34 is in a position where it is engaged with the wall 28*a*, the auxiliary reset member being adapted to drive the sliding head 34 away from engagement with the wall 28*a* when the first locking member moves.

2. A thrust-in operation type switching device as set forth in claim 1, wherein the reset member 15 has similar construction as the movable member 10 and has the same relation with the first locking member 22 as the movable member 10 has therewith.

3. At thrust-in operation type switching device as set forth in claim 1, wherein the movable member 10 and the reset member 15 are both formed in a bar-like configuration and are arranged in parallel to move in the same direction, and wherein the first locking member 22 is formed in a plate-like configuration and is arranged to move parallel to a plane defined by the movable member 10 and the reset member 15, said first locking member 22 being adopted to move in the direction perpendicular to the direction of motion of the movable member 10 and of the reset member 15.

4. A thrust-in operation type switching device as set forth in claim 3, wherein the first locking member 22 has first and second inclined surfaces 26*a* and 27*a* and wherein the movable member carries said engaging hook 14, and the reset member 15 carries a projection 18, the hook 14 and the projection 18 being adapted to respectively slide upon the inclined surfaces 26*a*, 27*a*, said first locking member 22 having an edge 26*b* formed at the opposite side to the inclined surface 26*a* along which the engaging hook 14 slides.

* * * * *